United States Patent [19]

Glasgo

[11] Patent Number: 4,632,159

[45] Date of Patent: Dec. 30, 1986

[54] CLAMP-ON MARKING TEMPLATE AND SAW GUIDE FOR MAKING DOVETAIL JOINTS

[76] Inventor: Marion L. Glasgo, 11010 SE. 297th, Auburn, Wash. 98002

[21] Appl. No.: 760,272

[22] Filed: Jul. 29, 1985

Related U.S. Application Data

[63] Continuation-in-part of Ser. No. 586,873, Mar. 7, 1984, Pat. No. 4,531,559.

[51] Int. Cl.[4] ..... B27F 1/00

[52] U.S. Cl. ..... 144/85; 33/197; 83/761; 144/114.5 R

[58] Field of Search ..... 83/761, 87.1; 144/85, 144/87, 144 R, 144.5 R; 33/562, 481, 197

[56] References Cited

U.S. PATENT DOCUMENTS

| | | | |
|---|---|---|---|
| 1,004,920 | 10/1911 | Shire | 83/761 |
| 1,535,661 | 4/1925 | Garrity et al. | 83/761 |
| 3,223,132 | 12/1965 | Erne | 144/87 |
| 3,424,450 | 1/1969 | Atkins | 269/87.1 |
| 3,878,875 | 4/1975 | McCord, Jr. | 144/87 |
| 4,168,730 | 9/1979 | Keller | 144/326 |
| 4,462,440 | 7/1984 | Dolfi | 144/85 |

FOREIGN PATENT DOCUMENTS

| | | | |
|---|---|---|---|
| 0042244 | 12/1981 | European Pat. Off. . | |
| 18775 | 7/1904 | Sweden | 83/761 |
| 890022 | 2/1962 | United Kingdom . | |
| 918930 | 2/1963 | United Kingdom . | |
| 1358254 | 7/1974 | United Kingdom . | |
| 1358771 | 7/1974 | United Kingdom . | |
| 1502596 | 3/1978 | United Kingdom . | |

*Primary Examiner*—W. D. Bray

*Attorney, Agent, or Firm*—Christensen, O'Connor, Johnson & Kindness

[57] ABSTRACT

A saw guide and marking template for marking and cutting pin and tail face cuts required in making dovetail joints. A central template having end faces that provide angled saw guides is clamped to the edge of the board to be worked. The angled saw guides can be repositioned by either rotating them about the end of its central template or inverting the entire device.

12 Claims, 15 Drawing Figures

Fig. 2.
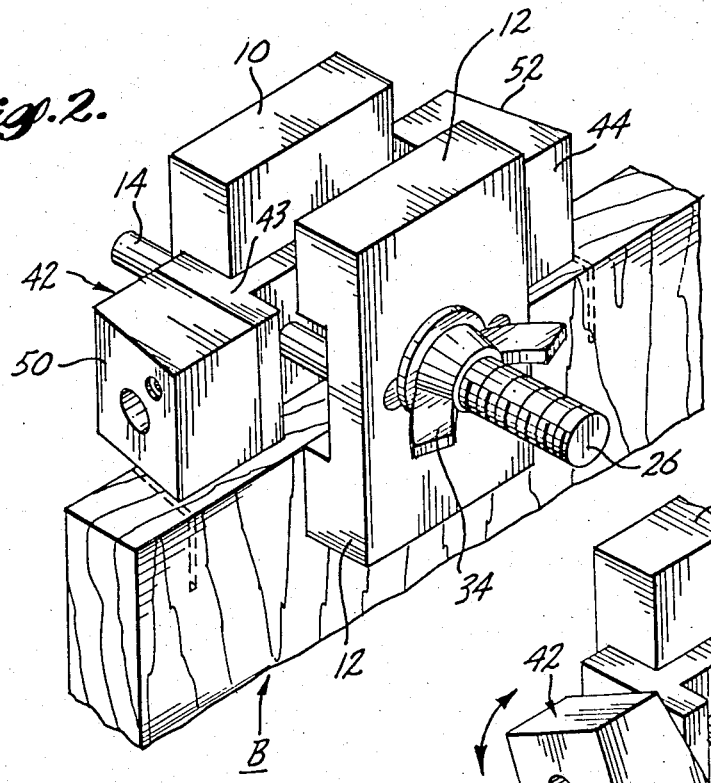
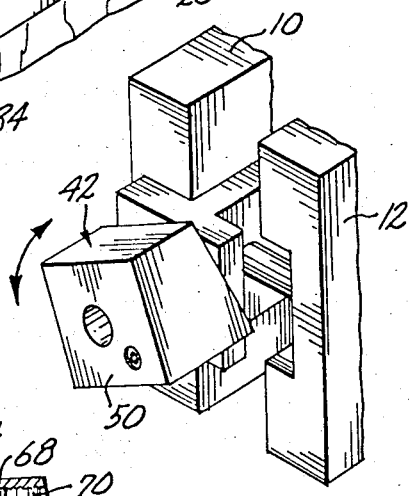
Fig. 4.
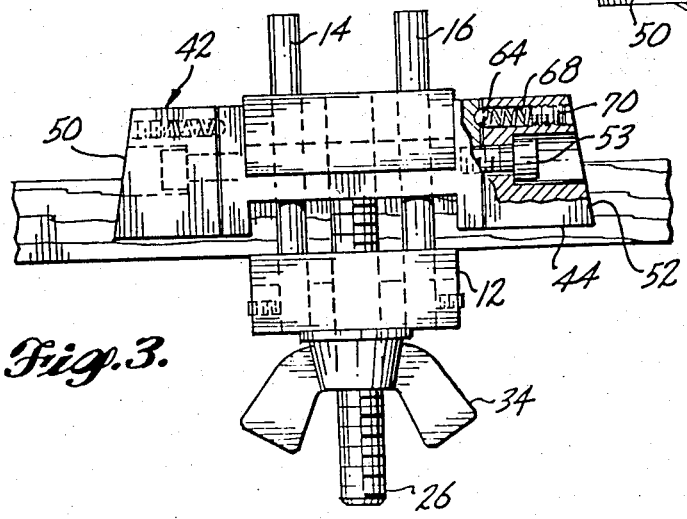
Fig. 3.

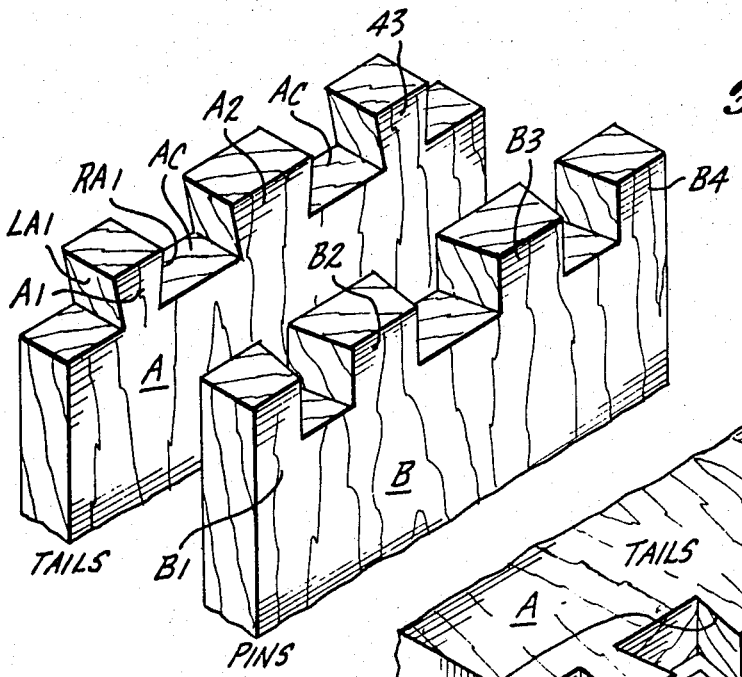
Fig. 8.
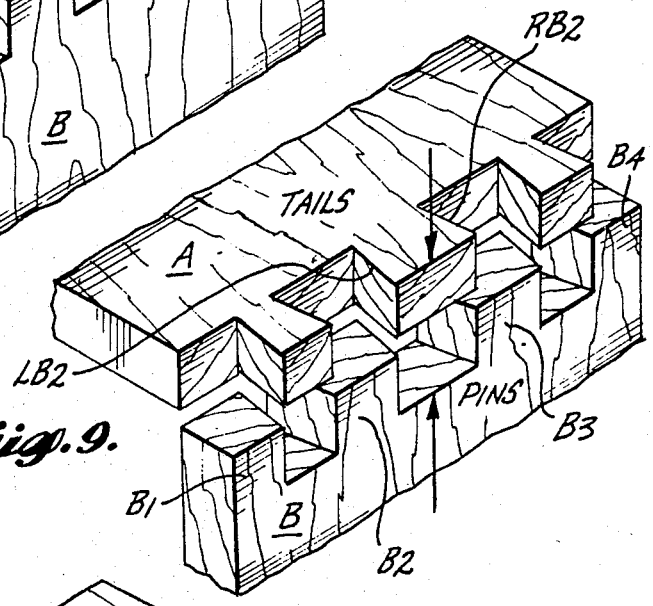
Fig. 9.
Fig. 10.
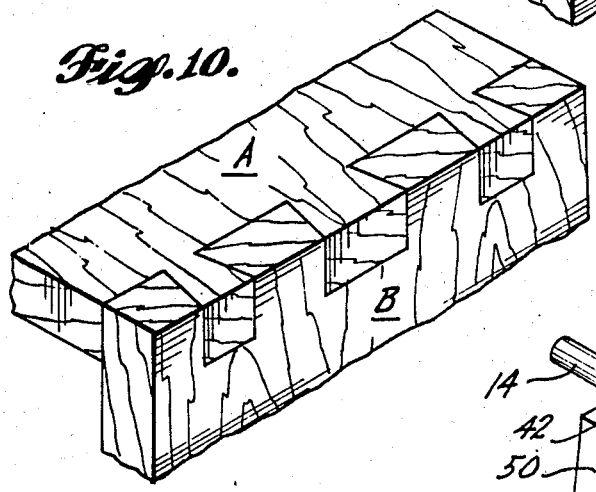
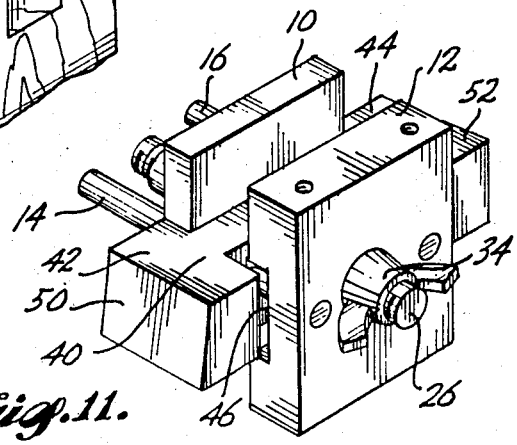
Fig. 11.

CLAMP-ON MARKING TEMPLATE AND SAW GUIDE FOR MAKING DOVETAIL JOINTS

BACKGROUND OF THE INVENTION

This is a continuation-in-part of my prior application, Ser. No. 586,873, filed Mar. 7, 1984, and entitled Clamp-on Marking Template and Saw Guide for Making Dovetail Joints, U.S. Pat. No. 4,531,559.

This invention relates to a new and improved marking and saw guide useful in cutting the pin elements and the tail elements of dovetail joints. The invention is herein illustratively described by reference to its presently preferred form; however, it should be appreciated that modifications and changes may be made therein without departing from the essential features involved.

In producing a dovetail joint, precision in cutting the pins and tails is essential if the joint is to have a presentable appearance and if it is to be strong and durable.

The principal object of the present invention is to provide a compact, versatile and inexpensive marking and saw guide for that purpose.

A more specific object is to devise an easily used guide combining guide retainer clamp and guide surface components so configured and related as to perform the desired marking and/or saw guide functions in all of the four necessary guide surface orientative positions, that is, in forming the left side and right side cuts of both the pin elements and the tail elements. The new guide is constituted to serve in this role with boards of any thickness within a wide range at all cutting stations along the entire length of the joint edge of the board (e.g., to the very ends of the edge as required).

SUMMARY OF THE INVENTION

In accordance with this invention, provided is a device for guiding a saw to form cuts in an edge of a board comprising: a template piece having at least one flat side for resting upon the edge of the board and guide blocks connected to the opposing ends of the template piece. One guide block is formed to have a surface oriented to guide a saw for cutting in a plane obliquely inclined to a plane that is parallel to the edge of the board upon which the template piece rests, the other guide block is formed to have a surface oriented to guide a saw for cutting at a plane obliquely inclined to any plane orthogonal to a plane that is parallel to the edge of the board upon which the template piece rests. Also provided are parallel clamp plates connected to the opposing sides of the template piece and extending along a pair of opposing sides of the board upon which the template piece rests. The clamp plates are operated by a clamp actuator screw so as to grip and hold a board between them with the template piece resting on the board's edge.

BRIEF DESCRIPTION OF THE DRAWINGS

FIG. 2 is an isometric view of the device secured to a board with the guide blocks positioned to cut the sides of pins;

FIG. 3 is a top view of the device with a partial cutaway portion illustrating the pivot and detent means of the guide blocks;

FIG. 4 is a partial isometric view illustrating rotation of one guide block;

FIG. 8 is an isometric view of the associated ends of boards formed with matched pins and tails;

FIGS. 9 and 10 show the boards first being moved into interengagement of the pins and tails and finally as interjoined in a dovetail joint in the usual manner;

FIG. 11 depicts an isometric view of an alternative embodiment;

DETAILED DESCRIPTION

Figure 1:
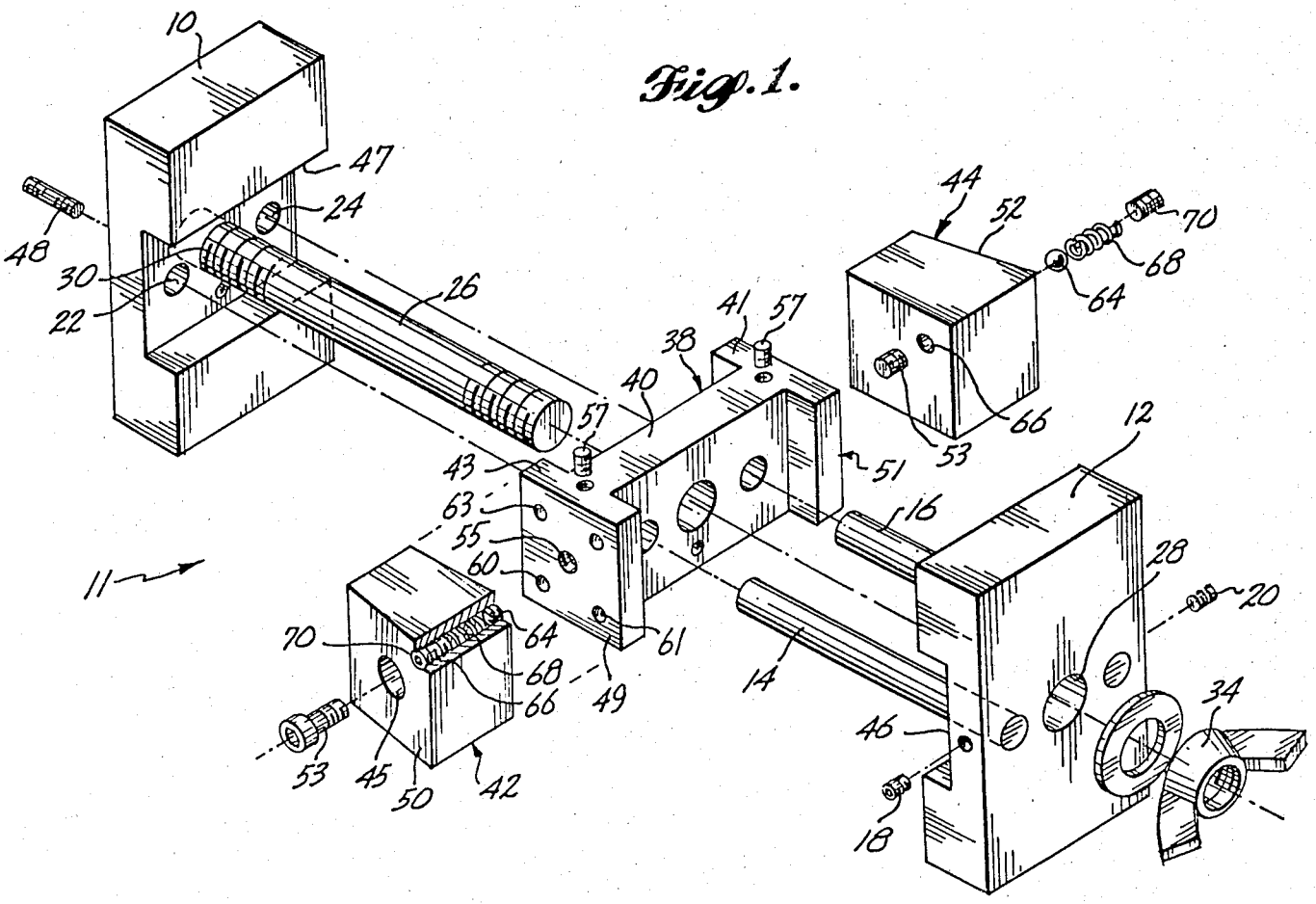
FIG. 1 is an exploded isometric view of the preferred embodiment.

Referring first to FIGS. 8–10, boards A and B have been prepared for interconnecting their ends by a so-called dovetail joint. The end of board A has been provided with a succession of tails and the end of board B with a succession of matching pins complemental to such tails. In the example, the tails are set back from the side edges of the board A to permit pins to be formed on the side edges of board B. It could, of course, be otherwise. In either case, tail $A_1$ has oppositely angled left and right side faces $LA_1$ and $RA_1$, which faces converge mutually with each angled in the plane of board A, such as at 80.5°, to the common plane defined by the tail base surfaces AC. The other tails have similarly angled side faces. Successive pins $B_1$, $B_2$, $B_3$ and $B_4$ have cut side faces similarly angled to (not "in") the plane of board B (such as left and right side face cuts $LB_2$ and $RB_2$ of pin $B_2$) so as to permit interengagement thereof with the tails by pressing the pins endwise of board B into interlocking engagement with tails $A_1$, $A_2$ and $A_3$, as shown by the arrows in FIG. 9, and by the completed resulting joint appearing in FIG. 10. Again, in the example, there is one more pin on board B than there are tails in board A, and the outer edge faces of the endmost pins are coextensive with the board's respective edges.

The improved tool comprises opposed generally rectangular clamp plates 10 and 12. Plate 12 has parallel guide shafts 14 and 16 projecting cantilevered from one face thereof held in bore holes in the plate by set screws 18 and 20. Projecting in fixed parallel relationship from the inside face of the plate in a transverse midplane thereof, the shafts are received in slidable engagement in similarly located bores 22 and 24 in opposing plate 10. The clamp actuator screw 26 passes slidably through aligned bore 28 in the plate 12 and engages threaded bore 30 in plate 10 midway between guide shafts 14 and 16. Wing nut 34 is threaded on the projecting end of the clamp screw 26 at the outside face of plate 12 and provides for forcing the plates together and into engagement with opposite faces of a wood board or panel and also backing off the plates when desired. Because of the intermediate location of the shafts 14 and 16 and screw 26 (also of the template piece 38 to be described) the tool is invertible, an important feature for reasons which will appear as the description proceeds.

Between the clamp plates 10 and 12 is a template piece 38 having bore holes located in alignment with the guide shafts 14 and 16 and slidably engaged therewith; also having a non-threaded bore hole to pass the clamp screw 26. Template piece 38 comprises a plate-like body 40 extending parallel to the clamp plates. A notch or recess 46 in the inner wall of the clamp plate 12 accommodates the body plate 40 with the clamp plates in their relatively most advanced position (toward each other). Plate 10 is similarly notched 47 and is secured to template body 40 by machine screw 48 so as to rigidify the joint. Body 40 lies between opposite faces of plates 10 and 12 and is preferably of a length in the plane of shafts 14 and 16 only very slightly exceeding the corresponding width of plates 10 and 12. The ends of body 40 form flange-shaped members 41 and 43 projecting orthogonally from the plane of body 40. The outwardmost surfaces 49 and 51 of the flange-shaped members provide surfaces upon which guide blocks 42 and 44 are rotatably mounted.

Referring, for simplicity, to one end of the template piece, guide block 42 is formed with center aperture 45. Aperture 45 is milled to accommodate countersunk pivot screw 53. The threaded end of the pivot screw 53 projects through the guide block 42 and mates with the threaded bore 55 formed in the center of surface end 49. Set screw 57 is inserted through the template piece through a bore so that force is applied against the threaded portion of pivot screw 53. The guide block is thus firmly mounted to the template piece and able to rotate about the longitudinal axis of that piece.

Referring to FIGS. 1, 3 and 4, the rotational movement of guide block 42 is controlled by detent means. Specifically, four hemispherical dimples 60–63 are formed at positions equidistant from the center of surface 49 and evenly spaced along a circle formed by a radius measured from the center of bore 55 to the center of any dimple. The purpose of the dimples is to receive spring-biased bearing 64. Bearing 64 resides in aperture 66 formed in guide block 42 and is forced toward the surface 49 by a spring 68 that is contained in the aperture by set screw 70. When guide block 42 is rotated to align aperture 66 with one of the dimples, spring 68 forces bearing 64 to seat in the hemispherical dimple, thereby securing the guide block in position until torsional force is applied by hand to overcome the spring force and rotate the guide block into another position. Dimples 60–63 are positioned so that, when secured by the above-described detent means, guide block 42 locks at four distinct positions so that the bottom side of the guide block will always assume a coplanar relationship with the bottom of template piece 38. This ensures that a flat, continuous surface is placed against the edge of a board. It is pointed out that identical mounting and detent means are applied to the other guide block 44, thus the same reference numerals are used in the drawings.

Referring now to FIGS. 2–7, the guide blocks 42 and 44 have precisely angled saw guide faces 50 and 52, respectively, forming the outwardmost longitudinal surfaces of the tool 11. Depending upon the orientation of a guide block, as discussed below, the corresponding guide face will provide a guide for marking or sawing a precise angular cut necessary for forming pins and tails. As will appear, the construction of closely interfitted parts assures precise orientation of the end face 50 of template head 42 and that of end face 52 of template head 44 and thereby assures correct orientation of these guide surfaces relative to board A or B in making cuts in the board to form the pins and tails.

Figure 5:
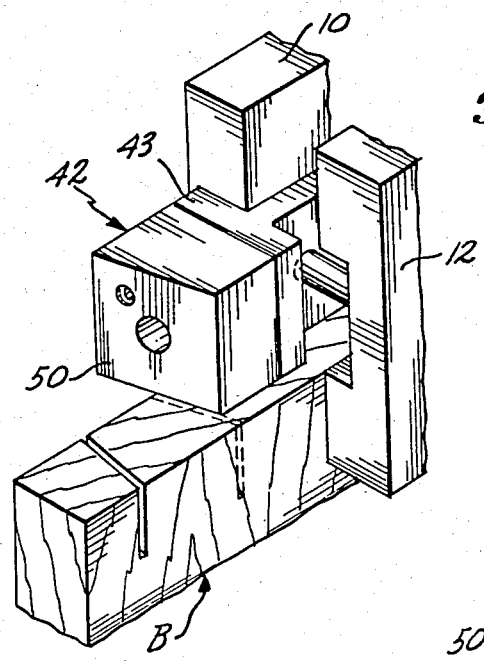
FIG. 5 is a partial isometric view illustrating the repositioning of the prominent guide block of FIG. 2 after a 180° rotation.
Figure 6:
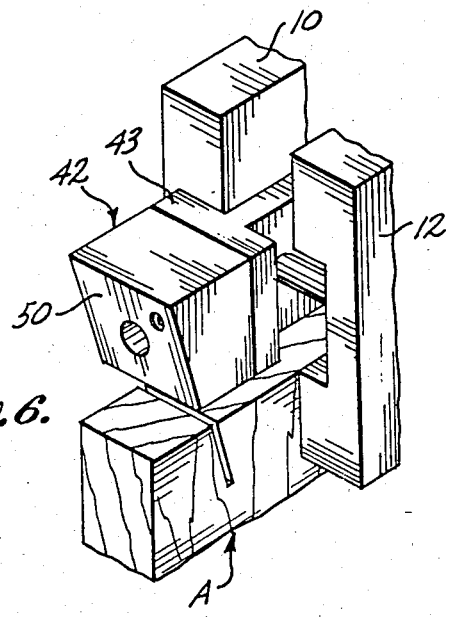
FIGS. 6 and 7 are partial isometric views of a guide block initially aligned to cut one side of a tail (FIG. 6) then rotated 180° to cut the opposite side of the tail (FIG. 7)
Figure 7:
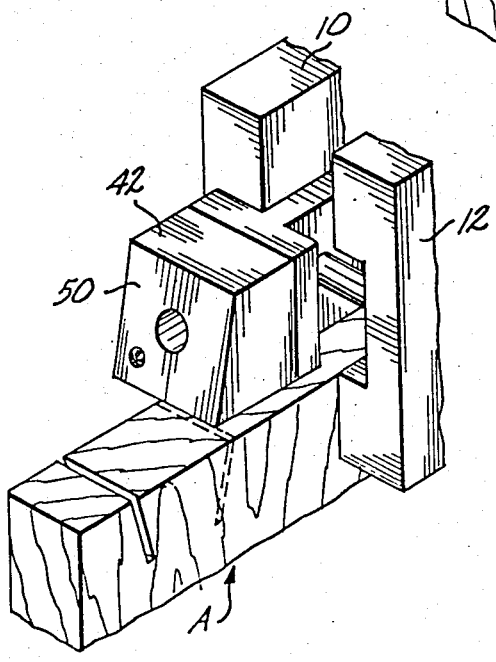

In normal operation, the tool's template piece is positioned at rest on the edge of the board and the board securely clamped between plates 10 and 12. Guide blocks 42 and 44 are rotated as shown in FIG. 4, to one of the four previously-described positions, the lower surface of each guide block rests firmly on the edge of the board. Depending upon how each guide block is rotated, end faces 50 and 52 are each capable of presenting guides for the four angles necessary for cutting tails and pins as shown in FIGS. 8 and 9 as reference letters $LA_1$, $RA_1$, $LB_2$ and $RB_2$. For example, FIG. 6 shows guide block 42 rotated and the tool securely clamped to board A to provide a guide face 50 for cutting or marking one side of a tail. FIG. 7 shows guide block 42 rotated, and the tools securely clamped, to provide a guide face 50 for cutting the opposite side of a tail. Similarly, FIG. 2 shows guide block 42 rotated to provide a guide face 50 for cutting or marking board B for one side of a pin and, finally, FIG. 5 shows guide block 42 rotated to provide a guide face 50 for marking or cutting the opposite side of a pin. Again, it is pointed out that the operation of the guide block 44 and saw guide face 52 on the other end of the template member is identical to that just described for guide block 42.

Working with either soft or hardwood may call for the tails and pins to be formed with different angular cuts. Therefore, the angles defined by saw guide faces 50 and 52 are not necessarily equal. This allows one tool to provide guides for cutting all four angles for two distinct sets of pins and tails. Additionally, because of the symmetrical design, the tool may be rotated about its vertical axis and reclamped to the board. This allows either saw guide face 50 or 52 to be used across the entire lengthwise edge of a board. It is pointed out that in lieu of rotating a particular guide block, the same effect may be achieved by inverting the entire tool on the edge of the board.

It will be recognized, once the angled faces of the pins and tails have been cut, that the worker must necessarily remove the intervening material where notches are to be formed, which he can do in any of different suitable ways convenient to his shop facilities and preferred technology.

If desired, the total physical length of the template piece or member 38 or of the guide heads 42 and 44 thereof may be selected as succession point gauges along the board's edge by which to position the tool at the proper spacing of marking and/or cutting points along such edge for cutting the pins and tails.

FIG. 11 depicts an alternative embodiment of the invention whereby guide blocks 42 and 44 are integrally formed with the template body 40. Instead of rotating one end of the device, the entire tool is inverted and reclamped to enable cutting both sides of pins or tails across the entire length of the board.

Figure 12:
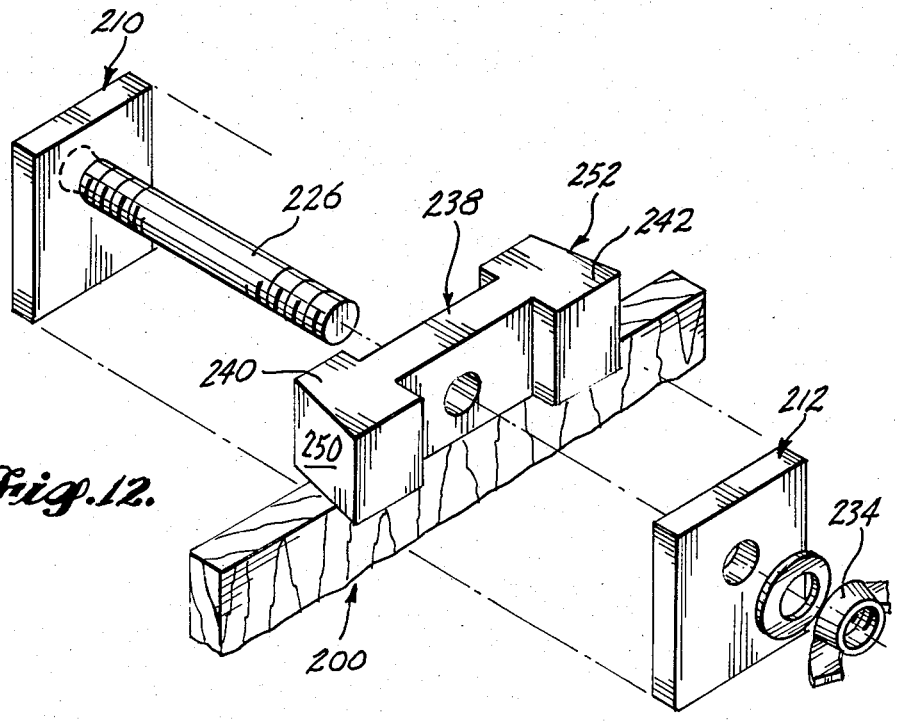
FIG. 12 is an exploded isometric view of an alternative embodiment wherein only the central template piece is rotated in order to cut both sides of the pins and tails.

Another alternative embodiment is shown in FIG. 12. There, the device is similar to the device as previously described except the clamp plates 210 and 212 have no notches in their inner walls and extend in essentially one direction only; downwardly along each side of the board 200 upon which the template piece 238 rests. In this embodiment, no guide shafts are employed so that when the clamp plates are loosened from the board by clamp actuator screw 226, the template piece 238 is inverted by rotation about the clamp actuator screw 226 to change the orientation of saw guide faces 250 and 252 relative to the board 200 for guiding the saw to form both sides of the pins and tails. The template piece 238 is shown with integrally formed guide blocks 240 and 242, however, it is contemplated that template piece 238 could also accommodate rotatable guide blocks such as discussed earlier with reference to FIGS. 1 through 7 and indicated by reference numerals 42 and 44.

Figure 13:
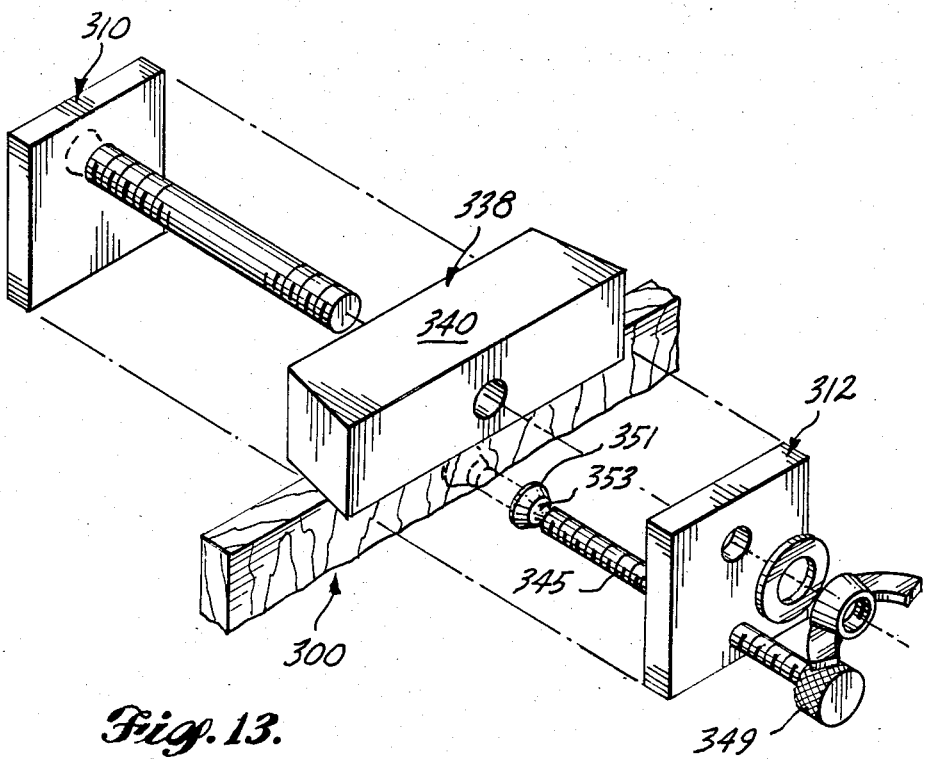
FIG. 13 is an exploded isometric view of another alternative embodiment illustrating an alternative method of securing the device to the board.

FIG. 13 illustrates an alternative method of securing the tool to the board. In this embodiment an elongated threaded member 345 is screwed through clamp plate 312. The threaded member 345 is rotated by hand via knurled knob 349 fixed to the outermost end of the threaded member. The inner end of the threaded member includes a foot piece 351 mounted to the threaded member by a conventional ball and socket joint 353. As the threaded member is screwed toward the board 300 the foot piece 351 eventually abuts the board. Tightening of the threaded member 345 secures the board between the foot piece 351 and the opposing clamp plate 310.

The embodiment of FIG. 13 also illustrates that the body 340 of template piece 338 can be of practically any width with respect to the board's edge since it is not necessary to bring both clamp plates 310 and 312 together to clamp onto the board.

Figure 14:
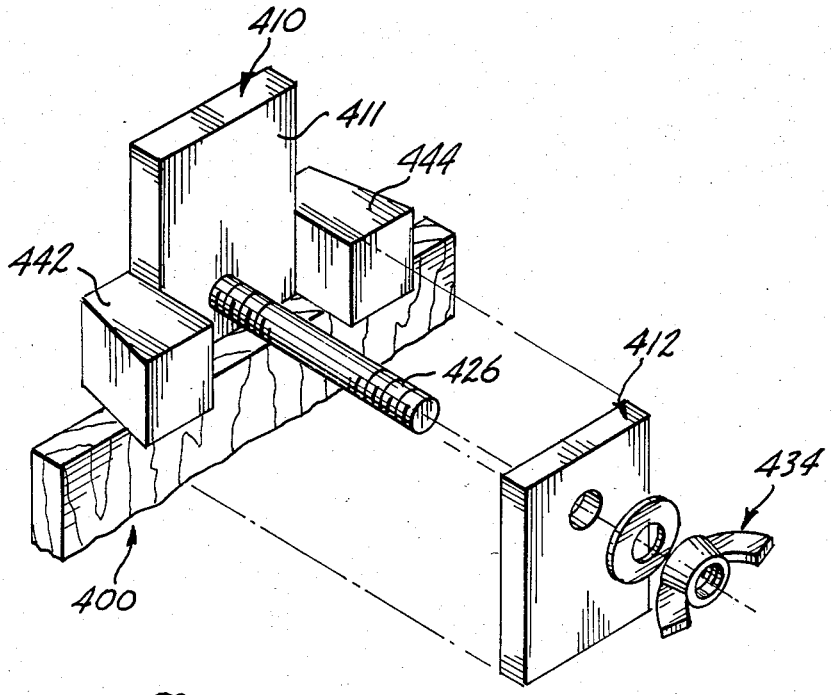
FIG. 14 is an exploded isometric view of another alternative embodiment wherein the blocks used for guiding the saw are integrally formed with one of the plates used for clamping the device to a board's edge; and, FIG. 15 is an exploded isometric view of still another alternative embodiment illustrating a simplified version of the device to be hand held on the edge of the board being cut.

FIG. 14 presents yet another alternative embodiment wherein guide blocks 442 and 444 are integrally formed with or otherwise fixed to one of the clamp plates 410 thereby obviating the need for a template piece. The device is operated substantially the same as described with respect to earlier devices wherein the opposing clamp plate 412 is drawn toward the board 400 by tightening wing nut 434 on clamp actuator screw 426. In order to cut both sides of the pins and tails it is necessary to invert the clamp plate 410 and reclamp the device onto the board 400. In this regard it is pointed out that clamp plate 410 not only extends along the side of the board but also upwardly from the board's edge. This upward extending portion 411 of clamp plate 410 permits the device to be clamped to the board after the clamp plate 410 has been inverted.

Figure 15:
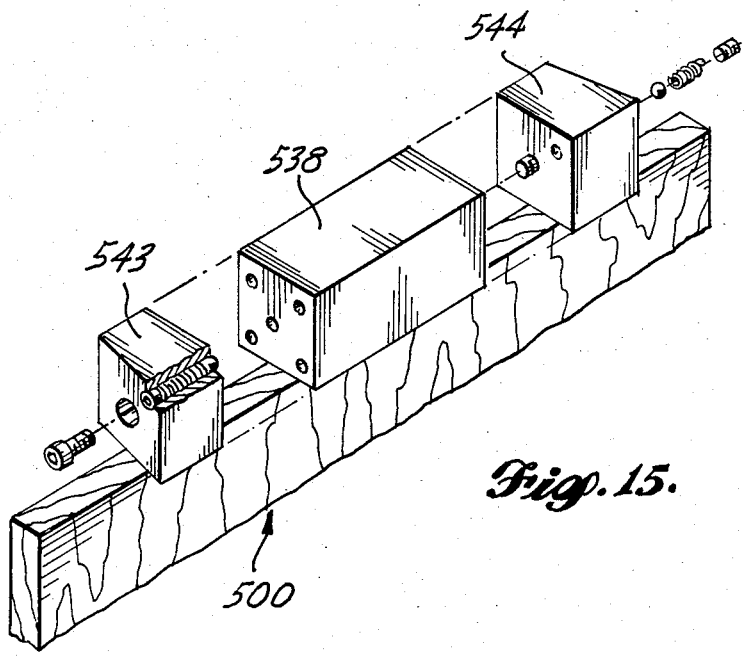

FIG. 15 illustrates a simplified version of the device formed in accordance with this invention comprising a template piece 538 with rotatable guide blocks 542 and 544 affixed thereto. The template piece and rotatable guide blocks are essentially the same as described earlier with reference to FIGS. 1–7 except that the template piece in this embodiment is configured to be operable without the use of attached clamp plates. Instead, the template piece can be secured to the board by hand or by any suitable clamping device available to the worker. As still another modification, the template piece 538 and only one of the guide blocks 543 or 544 could be integrally formed as a single unit. Rotation of this entire unit about either its vertical or horizontal axis will allow the end face of the unit to be oriented with respect to the board to cut either sides of both pins and tails as described earlier.

The embodiments of the invention in which an exclusive property or privilege is claimed are defined as follows:

1. A device for guiding a saw to form cuts in an edge of a board comprising:

(a) a template piece having at least one flat side for resting lengthwise upon said edge;

(b) guide blocks connected to the opposing ends of the template piece, one guide block being formed to have a surface oriented to guide a saw for cutting in a plane obliquely inclined to a plane that is parallel to the edge of the board upon which the template piece rests, the other guide block being formed to have a surface oriented to guide a saw for cutting in a plane obliquely inclined to any plane orthogonal to a plane that is parallel to the edge of the board upon which the template piece rests;

(c) parallel clamp plates connected to opposing sides of the template piece and extending along a pair of opposing sides of the board upon which the template piece rests; and (d) clamp means operatively associated with the clamp plates for holding the device in a fixed position on the board.

2. The device of claim 1 wherein the clamp means includes a clamp actuator screw extending through the clamp plates, the clamp actuator screw being operable to move the clamp plates toward the board.

3. The device of claim 1 wherein the clamp means includes at least one threaded member having a board abutting end, the threaded member extending through one clamp plate in substantially orthogonal relationship with the board, rotation of the threaded member causing the board abutting end of the threaded member to move toward or away from the board depending upon the direction of rotation of the threaded member.

4. The device of claim 1 wherein the template piece is integrally formed with one of the clamp plates.

5. The device of claim 1 wherein at least one of the clamp plates has an extension joined thereto, the extension projecting outwardly from the board's edge upon which the template piece rests in substantially parallel relationship with the clamp plates.

6. A device for guiding a saw to form cuts in the edge of a board, comprising:

parallel clamp plates positioned on opposing sides of the board with the edge of the board located between them;

a pair of guide blocks connected to one of the clamp plates and extending toward the other clamp plate, the guide blocks having at least one flat side for resting upon the board's edge, one guide block being formed to have a surface oriented to guide a saw for cutting in a plane obliquely inclined to a plane that is parallel to the edge of the board upon which the guide block rests, the other guide block being formed to have a surface oriented to guide a saw for cutting in a plane obliquely inclined to any plane perpendicular to a plane that is parallel to the edge of the board upon which the guide block rests; and, clamp means operatively associated with the clamp plates for holding the device in a fixed position on the board.

7. The device of claim 6 wherein the clamp means includes a clamp actuator screw extending through the clamp plates, the clamp actuator screw being operable to move the clamp plates toward the board.

8. The device of claim 6 wherein the clamp means includes at least one threaded member having a board abutting end, the threaded member extending through one clamp plate in substantially orthogonal relationship with the board, rotation of the threaded member causing the board abutting end of the threaded member to move toward or away from the board depending upon the direction of rotation of the threaded member.

9. A device for guiding a saw to form cuts in the edge of a board comprising an elongated template piece having two reference faces, the template piece also having a guide block attached to its outermost end, the outermost surface of the guide block defining a planar saw guide face, the template piece and guide block being configured so that when one of the reference faces is placed on the edge of the board, the saw guide face is angled obliquely to a plane that is parallel to the edge of the board upon which the reference face is placed, the template piece and guide block being configured so that when the template piece is rotated 90° about its longitudinal axis, the other reference face is positionable upon the edge of the board and the saw guide face is angled obliquely to any plane orthogonal to a plane that is parallel to the edge of the board upon which the other reference face is placed.

10. The device of claim 9 further including parallel clamp plates connected to opposing sides of the template piece and extending along a pair of opposing sides of the board on which the template piece is placed; and clamp means operatively associated with the clamp plates for holding the device in a fixed position on the board.

11. The device of claim 10 wherein the clamp means includes a clamp actuator screw, extending through the clamp plates, the clamp actuator screw being operable to move the clamp plates toward the board.

12. The device of claim 10 wherein the clamp means includes at least one threaded member having a board abutting end, the threaded member extending through one clamp plate in substantially orthogonal relationship with the board, rotation of the threaded member causing the board abutting end of the threaded member to move toward or away from the board depending upon the direction of rotation of the threaded member.

* * * * *